United States Patent [19]

Ewart

[11] 4,008,456

[45] Feb. 15, 1977

[54] TACTILE TARGET ALERTING SYSTEM

[75] Inventor: Wade H. Ewart, Guntersville, Ala.

[73] Assignee: The United States of America as represented by the Secretary of the Army, Washington, D.C.

[22] Filed: June 30, 1975

[21] Appl. No.: 591,801

[52] U.S. Cl. ..... 340/6 R; 340/5 T

[51] Int. Cl.[2] ..... G01V 1/00; H04B 13/00; H04R 15/00

[58] Field of Search ..... 343/112 R; 340/5 T, 340/6 R

[56] References Cited

UNITED STATES PATENTS

| | | | |
|---|---|---|---|
| 3,337,839 | 8/1967 | Nelkin | 34/1 |
| 3,736,551 | 5/1973 | Hirsch | 340/5 T |
| 3,742,440 | 6/1973 | Ehrlich et al. | 340/5 T |

*Primary Examiner*—Maynard R. Wilbur
*Assistant Examiner*—T. M. Blum
*Attorney, Agent, or Firm*—Nathan Edelberg; Robert P. Gibson; Robert C. Sims

[57] ABSTRACT

A close-fitting garment has a pattern of tactile stimulators arranged on its surface. The stimulators can be selectively energized from some remote point in accordance with threats to a person wearing the garment. The stimulators are controlled by a radio receiver fed by a radio transmitter. The relative position of an energized stimulator on the garment is indicative of the relative position of the threat to the wearer. Frequency or amplitude of the stimulator can be used to give information such as threat speed or relative danger.

1 Claim, 5 Drawing Figures

TACTILE TARGET ALERTING SYSTEM

DEDICATORY CLAUSE

The invention described herein may be manufactured, used, and licensed by or for the Government for governmental purposes without the payment to me of any royalties thereon.

BACKGROUND OF THE INVENTION

There are various known ways by which a soldier can become aware of targets such as aircraft and tanks in his area. He may visually sight them himself, he may be advised by wire or radio, he may have his own radar or infrared detector. In the case of high-performance aircraft targets flying at low altitudes, visual sightings are not too useful. That is, by the time the soldier sees the target it is gone. The other ways mentioned above require that the soldier monitor some sort of receiver; these ways do not allow the soldier to have hands on his weapon. The instant invention allows the soldier to receive target information with no distractions from his weapon, be it Redeye missile or antitank weapon.

SUMMARY OF THE INVENTION

The invention is a tactile target alerting system in the form of a pattern of tactile stimulators on a close-fitting garment designed to be worn by a person. The stimulators can be selectively energized by a radio receiver receiving information from some distant point. The relative position of an energized stimulator on the garment is indicative of the position of a target with respect to the wearer of the garment. The stimulators may be arranged in a circle or in a two-dimensional array. The stimulators may also indicate relative velocity or threat of a target by relative variations in amplitude or frequency of stimulation.

DETAILED DESCRIPTION OF THE INVENTION

Figure 1:
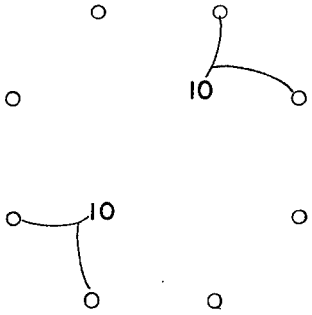
FIG. 1 shows one layout for the invention.
Figure 2:
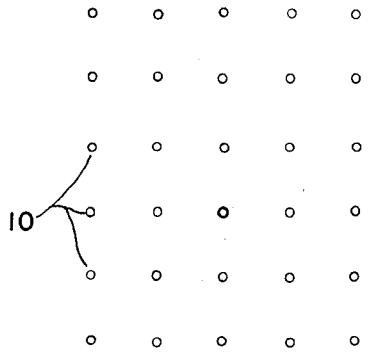
FIG. 2 shows another layout for the invention.

The invention may be best understood by referring to the drawings, in which FIG. 1 shows a circular arrangement of tactile stimulators 10. FIG. 2 shows a two-dimensional array of stimulators 10. Obviously there could be more or less stimulators in either arrangement, as desired or needed.

Figure 3:
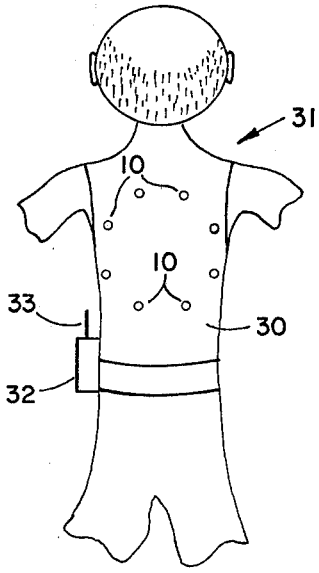
FIG. 3 shows a person with the invention as shown in the layout of FIG. 1 in place.

FIG. 3 shows the arrangement of stimulators as shown in FIG. 1 on close-fitting vest 30 on person 31. The stimulators can be selectively energized by radio receiver 32 with antenna 33. Simulators 10 may be some sort of vibrators or other tactile transducers. Obviously, wires (not shown) would connect receiver 32 and stimulators 10.

Figure 4:
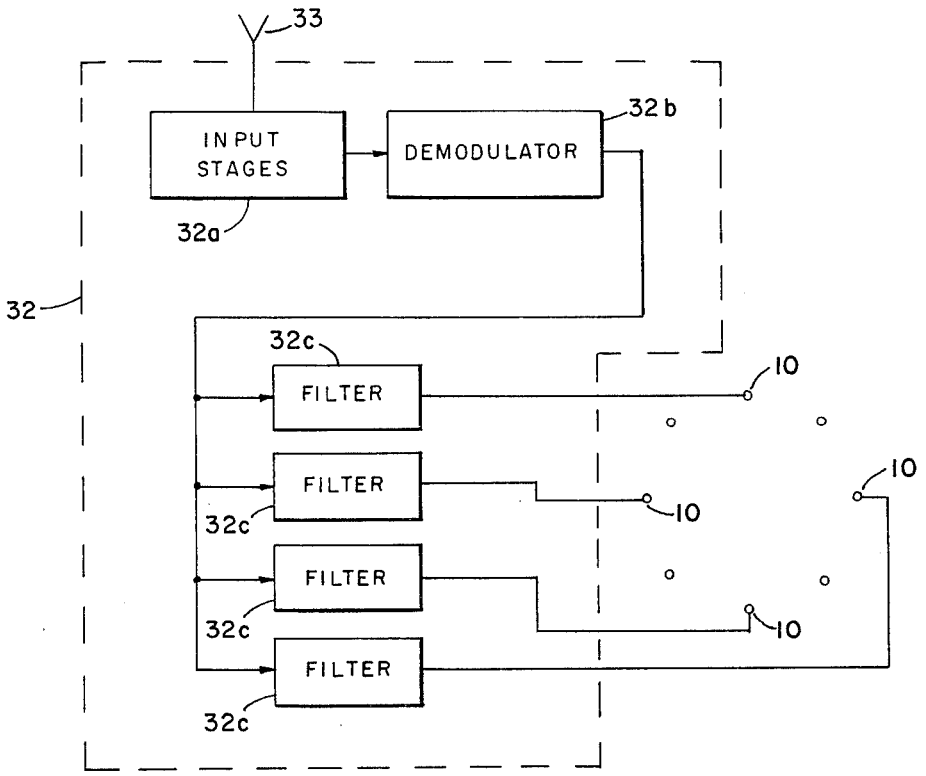
FIG. 4 is a schematic diagram of a receiver usable with the invention.

FIG. 4 shows some details of receiver 32. This receiver includes input stages 32*a* connected to antenna 33, with the output of 32*a* feeding demodulator 32*b*.

The output of 32*b* feeds plural filters 32*c*. Filters 32*c* in turn energize stimulators 10 through respective connecting leads.

Figure 5:
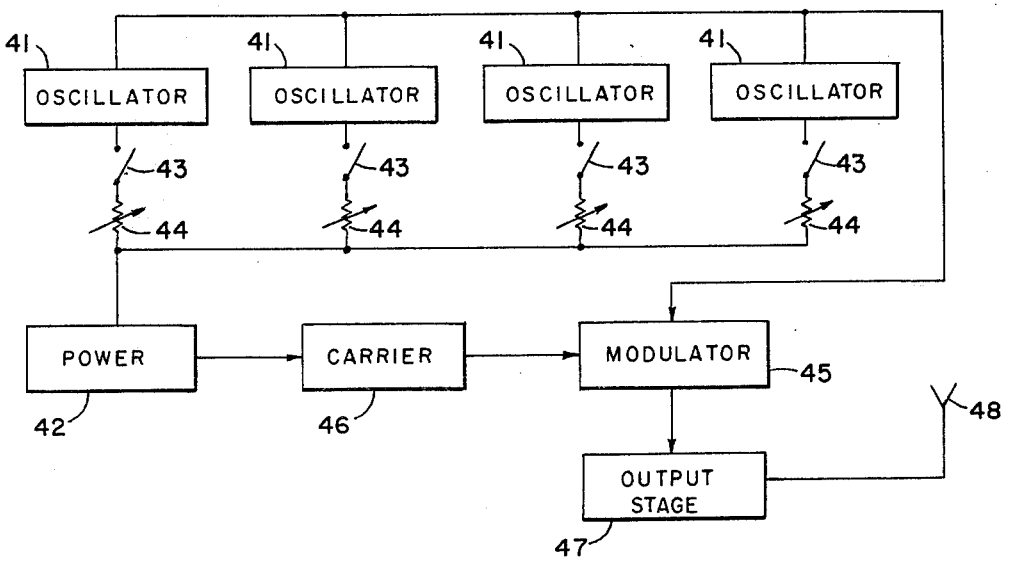
FIG. 5 is a schematic diagram of a transmitter usable with the invention.

FIG. 5 shows a transmitter for supplying information to receiver 3. This transmitter includes oscillators 41, each connectable to power source 42 through a respective switch 43 and variable resistor 44. The outputs of the various oscillators are fed to modulator 45. Also fed to modulator 45 is the output of carrier generator 46. Modulator 45 provides an output to output stage 47 feeding transmitting antenna 48.

In operation, for targets in particular directions, particular ones of switches 43 of the transmitter are closed, to energize its respective oscillator. The oscillator output(s) modulates the carrier wave and is (are) transmitted from antenna 48. It should be noted that oscillators 41 are tuned to different frequencies. Variable resistors 44 allow the relative amplitudes of the oscillator outputs to be adjusted, in accordance with target speed or threat.

The modulated wave from the FIG. 5 transmitter is received by the FIG. 4 receiver 32 on antenna 33, is amplified etc. in the usual manner, and is demodulated in demodulator 32*b*. The output of 32*b* goes to filters 32*c*, as previously described. Filters 32*c* are tuned to correspond to the frequencies of oscillators 41 of FIG. 5. Thus respective ones of stimulators 10 are energized in accordance with the settings of switches 43 in FIG. 5.

In FIGS. 4 and 5 only four oscillators 41 and filters 32*c* have been shown and described. This was done to avoid unnecessary complication of the drawings. Obviously, there would be a number of oscillators and filters equal to the number of stimulators in the particular stimulator pattern being used. If desired, each oscillator 41 could be switched on and off by some pulser between respective oscillator 41 and switch 43. This on-off pulsing could replace or supplement variable resistors 44.

The pattern of stimulators as shown in FIG. 1 is used assuming that wearer of the invention is in the center of the circle defined by the stimulators. The stimulator at the top of the drawing is taken as being at north, and that stimulator 90° clockwise is taken as east. Therefore the wearer of the invention is advised as to the roughly true direction(s) of a target(s). The pattern of FIG. 2 may be used with coordinates on a battlefield map. The wearer should be aware of his position on the map, and can determine relative positions of targets depending on the stimulators energized.

I claim:

1. A tactile target alerting system for a person; including a close-fitting garment for the person; a circle pattern of sensation producing means in the surface of said garment; a plurality of filter means each passing a different frequency individually connected to said pattern of sensation producing means for selectively energizing said sensation producing means; a plurality of oscillator means equal in number to said filter means; switching means connected to said oscillator means so as to selectively energize desired ones of said oscillator means; connecting means connecting said oscillators to said filter means; control means connected to each oscillator so as to variably control the power output of said oscillator; and power means connected to said switching means to provide power for said oscillators.

* * * * *